United States Patent [19]

Sakai et al.

[11] Patent Number: 4,979,452

[45] Date of Patent: Dec. 25, 1990

[54] SHIP HAVING A DOME ON ITS UPPER DECK

[75] Inventors: Daisuke Sakai; Kunifumi Hashimoto; Hiroshi Shirakihara, all of Nagasaki, Japan

[73] Assignee: Mitsubishi Jukogyo Kabushiki Kaisha, Tokyo, Japan

[21] Appl. No.: 436,971

[22] Filed: Nov. 16, 1989

Related U.S. Application Data

[63] Continuation of Ser. No. 238,822, Aug. 31, 1988, abandoned.

[30] Foreign Application Priority Data

Sep. 16, 1987 [JP] Japan ..... 62-231277
Mar. 30, 1988 [JP] Japan ..... 63-77654

[51] Int. Cl.[5] ..... B63B 11/02; B63B 25/16
[52] U.S. Cl. ..... 114/74 A; 220/901
[58] Field of Search ..... 220/901; 114/74 R, 74 A

[56] References Cited

U.S. PATENT DOCUMENTS 3,724,411 4/1973 Alleaume ..... 114/74 A
3,896,754 7/1975 Tanaka ..... 114/74 R
3,968,764 7/1976 Kvamsdal et al. ..... 114/74 A

*Primary Examiner*—Sherman Basinger
*Attorney, Agent, or Firm*—Wenderoth, Lind & Ponack

[57] ABSTRACT

A ship has on its upper deck a dome disposed between adjacent of transverse bulkheads aligned in the bow-stern direction of a hull and covering an opening in the upper deck. The dome is formed as a hemispherical shell-like member having a rigid structure. A short cylindrical member connects the circumferential edge portion of the hemispherical shell-like member with the circumferential edge portion of the opening in the upper deck. The transverse bulkheads of the hull are formed as a flexible structure having large openings. In a liquefied gas carrying vessel, a spherical tank for storing liquefied gas is disposed between the adjacent transverse bulkheads of the hull and projects upwards through the opening of the upper deck, and the dome covers the upper portion of the spherical tank.

2 Claims, 23 Drawing Sheets

SHIP HAVING A DOME ON ITS UPPER DECK

This application is a continuation of now abandoned application, Ser. No. 07/238,822, filed Aug. 31, 1988.

BACKGROUND OF THE INVENTION

1. Field of the Invention

The present invention relates to a ship having a dome on its upper deck, and more particularly to a hull construction favorable for use in a liquefied gas carrying vessel in which a tank cover formed as a dome is additionally provided so as to cover a spherical tank projecting upwards from an upper deck.

2. Description of the Prior Art

Heretofore, liquefied gas carrying vessels employing a tank cover of hemispherical shape having a ribless structure have been known, and such tank cover structure is shown in FIGS. 8 to 12. In these figures, FIG. 8 is a transverse cross-sectional view of a hull, FIG. 9 is a partial longitudinal cross-sectional view of the hull, FIG. 10 is a partial top view of the hull, and FIG. 11 is a partial cross-sectional view taken along line a—a in FIG. 10 as viewed in the direction of the arrows.

Expansion joints 4 are disposed in the lengthwise direction as well as in the widthwise direction of a ship in a ribless tank cover 3 consisting of a hemispherical shell-like member that is provided on an upper deck 2 for the purpose of shielding a liquefied gas tank 1 from atmospheric air and sea water. The cross-sectional configuration of the expansion joint 4 is a closed rectangular shape as shown in FIG. 11. The expansion joints 4 are provided for the purpose of preventing buckling of the tank cover 3 due to high stress produced at the joint portion between the tank cover 3 and the upper deck 2, by absorbing deformation of the tank cover 3 and lowering stress produced in the tank cover 3 when the tank cover 3 is forcibly deformed due to deformation of the hull.

According to the knowledge of the prior art, it was considered to be natural that a structure largely influenced by deformation of a hull, such as the tank cover 3 (for instance, an upper structure of a car carrier or the like), be associated with a structure for absorbing deformation such as the above-mentioned expansion joint in order to avoid high stress caused by longitudinal bending deformation of the hull. However, in the case of tank cover 3 formed as a hemispherical shell-like member, the interference force exerted between the hull and the tank cover 3 is largest at the front and rear ends and at the left and right ends. Moreover, the expansion joints 4 are disposed just in the direction of connecting the front and rear ends and in the direction of connecting the left and right ends of the cover. Further, while the expansion joint 4 has good expansibility in its widthwise direction it is very rigid in its lengthwise direction, so that in the hatched portions shown in FIGS. 8 to 10 very large interference forces act between the tank cover 3 and the upper deck 2. With respect to practically built ships of the above-mentioned type cracks or break-down of welded portions area generated in such hatched portions.

It is to be noted that an annular upper deck portion, that is a portion of the upper deck 2 adjacent to the circumferential edge of a circular opening, does not include skelton members such as small ribs or girders and is formed as a flexible structure having brackets.

In addition, as shown in FIG. 12, a transverse bulkhead 16 in the heretofore known ship had a structure extended almost over the entire plane of the transverse cross-section of the hull. Hence, the rigidity of the hull is large, and the hull had such structure that the above-mentioned interference forces hardly could be absorbed by the side of the hull.

As described above, although expansion joints have been heretofore frequently used in a dome structure that is largely influenced by deformation of a hull such as a tank cover in a liquefied gas carrying vessel, there was the problem that difficulty with effectiveness of the expansion joints was liable to occur.

Hence, if a structure not provided with an expansion joint is employed, the above-mentioned difficulty would be eliminated, but, it would be necessary that the relative displacement between the hull and the dome, which was absorbed by the expansion joint in the prior art, be absorbed by a portion other than the expansion joint, or that the hull deformation per se be made small.

SUMMARY OF THE INVENTION

It is therefore one object of the present invention to provide a ship having a dome on its upper deck, wherein relative deformation between a hull and the dome is caused to be absorbed by a hull structure and a short cylindrical member.

According to one feature of the present invention, in order to achieve the above-mentioned object, the dome is disposed between adjacent ones of transverse bulkheads aligned in the bow-stern direction of the hull and covering an opening in the upper deck. The dome is formed as a hemispherical shell-like member having a rigid structure. A short cylindrical member connects the circumferential edge portion of the hemispherical shell-like member with the circumferential edge portion in the opening of the upper deck. The transverse bulkheads of the hull are formed as a flexible structure having large openings.

According to the present invention, in the ship having a dome on its upper deck constructed in the above-described manner, in the event that a longitudinal bending moment acts on the hull, the interference forces between the hull and the dome generated by such moment are absorbed by the transverse bulkheads of the hull having a flexible structure, and also are absorbed by bending of the short cylindrical member per se interposed between the dome and the circumferential edge portion of the circular opening in the upper deck.

The above-mentioned and other objects, features and advantages of the present invention will become more apparent by reference to the following description of one preferred embodiment of the invention taken in conjunction with the accompanying drawings.

BRIEF DESCRIPTION OF THE DRAWINGS

In the accompanying drawings

DESCRIPTION OF THE PREFERRED EMBODIMENT

Figure 1:
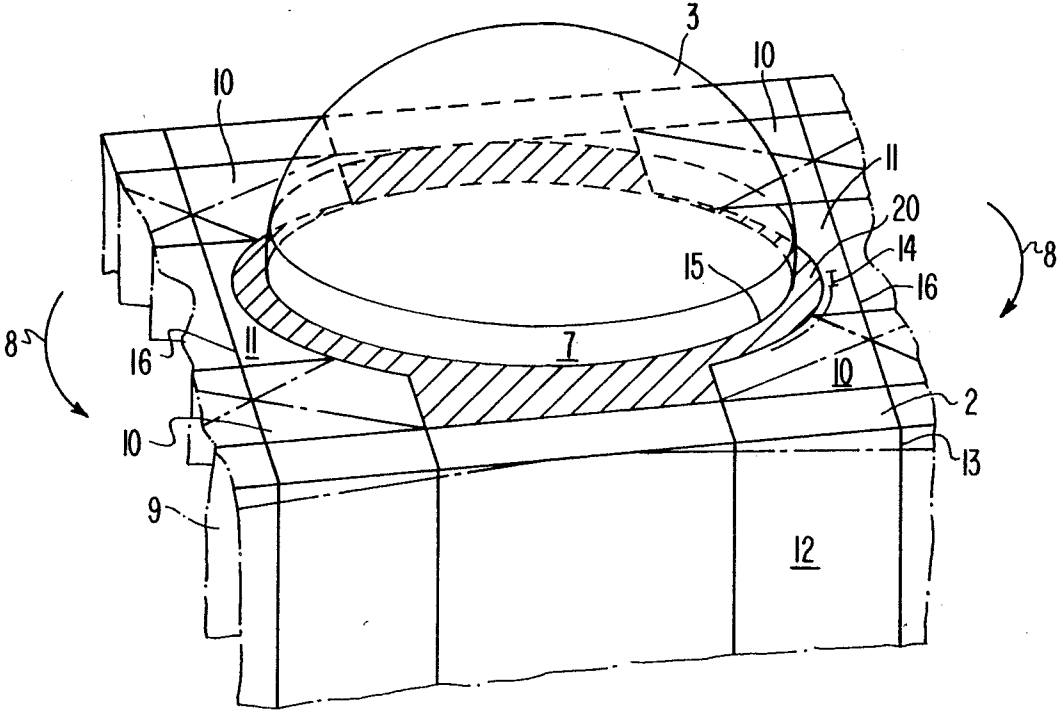
FIGS. 1 through 7 show a liquefied gas carrying vessel associated with a tank cover according to one preferred embodiment of the present invention FIG. 1 being a perspective view of an essential part of a hull in the liquefied gas carrying vessel, FIG. 2 being a transverse cross-sectional view of the hull, FIG. 3 being a longitudinal cross-sectional view of an essential part of the hull, FIG. 4 being a front view of a transverse bulkhead in the hull, FIG. 5 being a longitudinal cross-sectional view taken along the center line of the hull, FIGS. 6A–6B being perspective cross-sectional views of a central portion of the hull, and FIGS. 7(*a*), 7(*b*) and 7(*c*) being schematic views showing operations of the tank cover and short cylindrical member.
Figure 2:
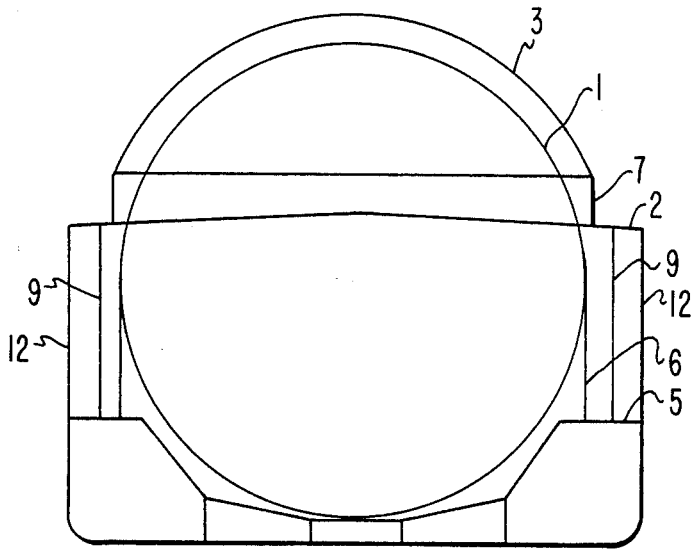
Figure 3:
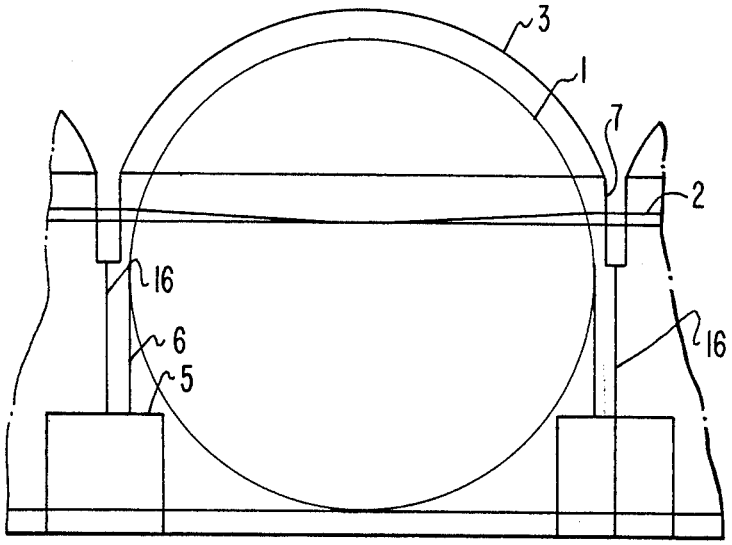
Figure 4:
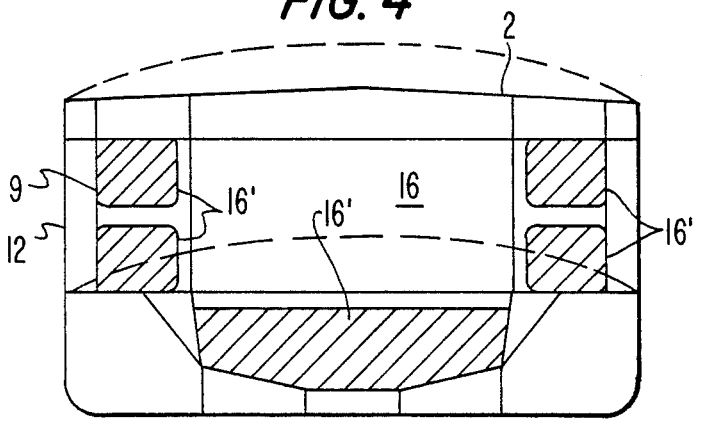
Figure 5:
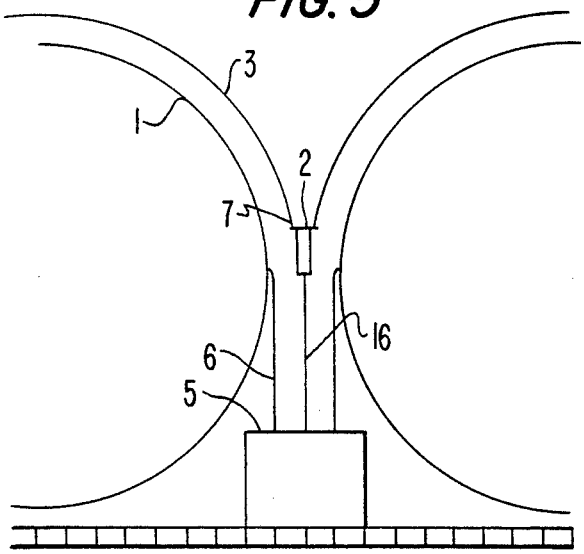
Figure 6A:
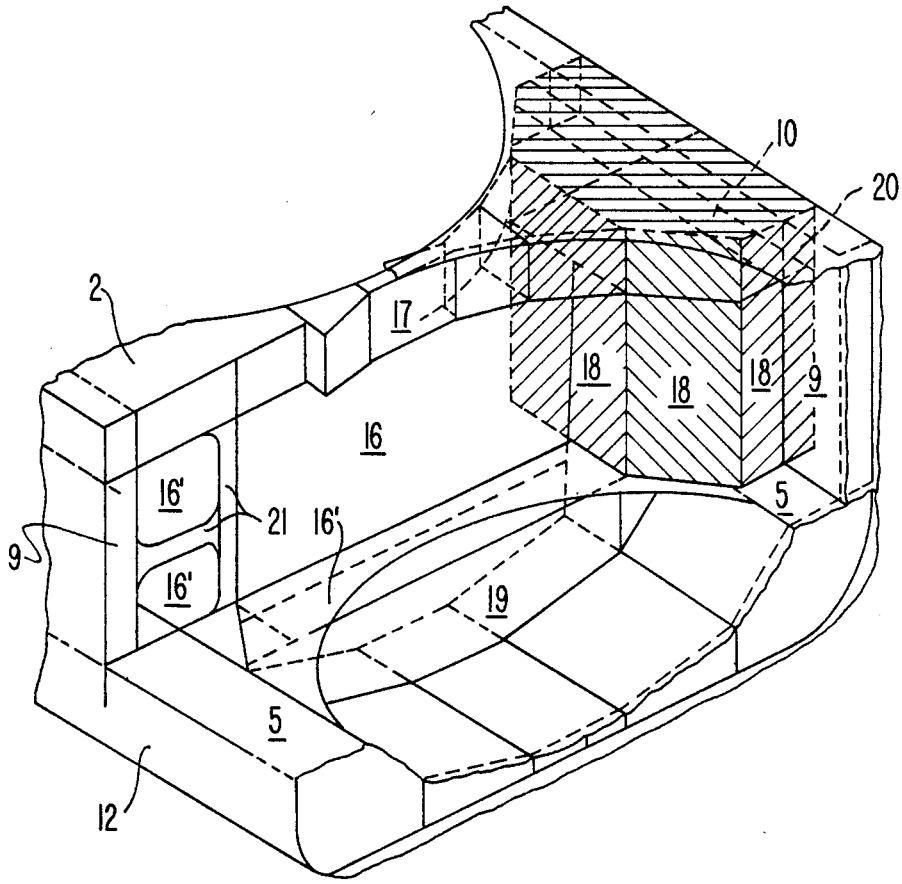
Figure 6B:
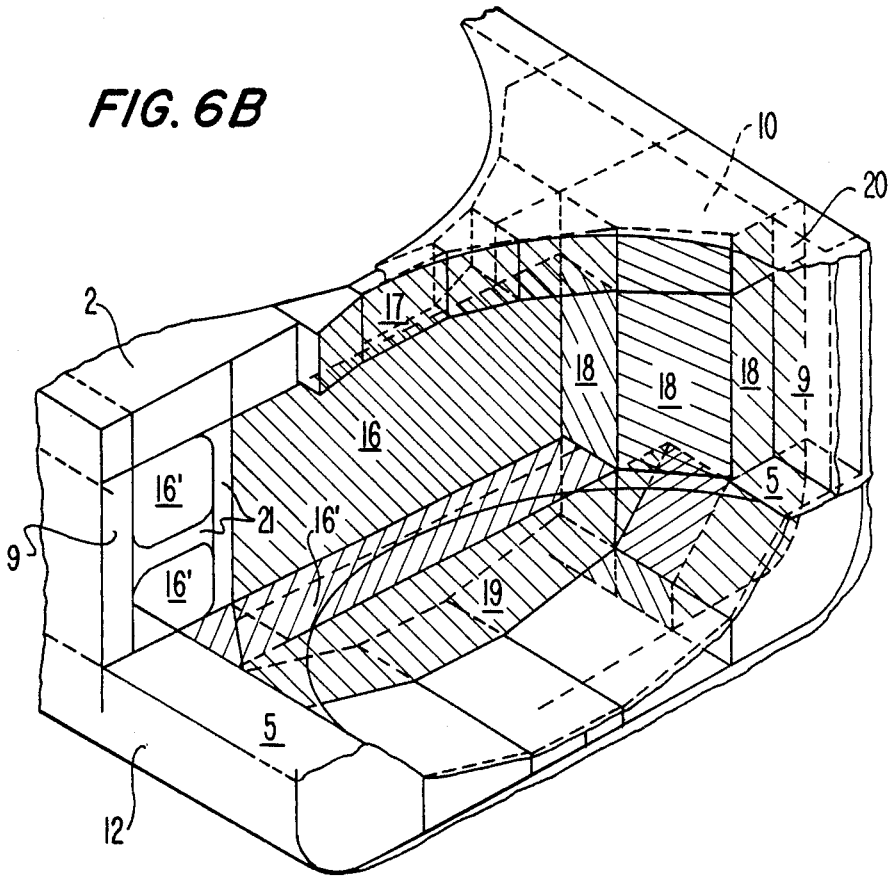

In the following, description will be made of a liquefied natural gas carrying vessel (LNG carrier) associated with a tank cover according to one preferred embodiment of the present invention with reference to the accompanying drawings, in which FIG. 1 is a perspective view showing an essential part of a hull, FIG. 2 is a transverse cross-sectional view of the hull, FIG. 3 is a partial longitudinal cross-sectional view of the hull, FIG. 4 is a front view of a transverse bulkhead in the hull, FIG. 5 is a partial longitudinal cross-sectional view taken along a center line of the hull, and FIGS. 6A–6B are perspective cross-sectional views of a central portion of the hull.

As shown in FIGS. 1 to 6B, between adjacent transverse bulkheads 16 of a hull aligned in the bow-stern direction, a spherical tank 1 for liquefied gas is disposed on a foundation deck 5 via a cylindrical skirt 6 so as to project upwards through a circular opening in an upper deck 2, and in order to cover the upper portion of this tank 1 for shielding it from atmospheric air and sea water, a tank cover 3 having a boneless or ribless structure formed as a hemispherical shell-like member having a rigid structure is joined to the upper deck 2 via a short cylindrical member 7 connected in a circular opening in the upper deck 2. The tank cover 3 is not provided with any expansion joint at all, and accordingly tank cover 3 has a rigid structure.

On the other hand, each transverse bulkhead 16 in the hull is provided with large openings 16' which have large widths in the widthwise direction of the hull as shown in FIGS. 4 and 6A–6B, resulting in a flexible structure. Such large openings, those large openings 16' on opposite sides of the bulkhead are provided within side ballast tanks 10. In the heretofore known ships such a large opening 16' was not provided, and the side ballast tank 10 was divided by the bulkhead into two tanks at the front and at the rear. In the illustrated embodiment of the present invention, the bulkhead 16 within the ballast tanks 10 is in the form of large ribs 21, and the tank 10 forms a single tank integrating front and rear portions. Thus, the right side portion of FIG. 6A shows one such integrated side ballast tank 10 according to the present invention. A similar single integrated side ballast tank would be provided on the other side of the hull, i.e. the left side of FIG. 6A, but is not shown therein. Rather, the left side portion of FIG. 6A shows two large openings 16' extending through the portion of the bulkhead within such other single integrated ballast tank. Particularly, this portion of the bulkhead is in the form of ribs 21 of the material of the bulkhead. The problem of safety upon flooding arising as a result of the provision of the large openings 16' is resolved by isolating the respective holds by means of water-tight plates 17, transverse bulkheads 16, ballast tank walls 18, foundation deck 5 and a stool plate 19, as shown by shaded lines in FIG. 6B. Thus, by providing this type of water-tight arrangement between adjacent holds, it is possible to provide the large openings 16' within the bulkheads in the areas passing through the tanks.

In addition, an annular upper deck portion 20 of flexible structure having no rib members as shown by hatching in FIG. 1 is disposed at the location adjacent to the circumferential edge of a circular opening of the upper deck 2. It is to be noted that in these figures, reference numeral 9 designates longitudinal bulkheads, numeral 11 designates cross deck portions, and numeral 12 designates side plates.

Owing to the above-mentioned construction, in the event that a longitudinal bending moment 8 acts upon the hull, the structure composed of the annular upper deck portion 20 surrounded by the longitudinal bulkheads 9, the ballast tanks 10 and the cross deck portions, and the tank cover 3 has a large rigidity, as a whole, against the bending moment 8, because the tank cover 3 has no expansion joint and the tank cover 3 itself is considerably rigid. Furthermore, on the side of the hull, as compared to the amount of deformation 13 of the side plates 12 caused by the bending moment 8, the amount of deformation 14 of the structure composed of the annular upper deck portion 20 and the tank cover 3 is small by a factor of about ¼ to 1/5.

At this time, the transverse bulkhead 16 deforms as shown by dotted lines in FIG. 4, and thereby absorbs the relative deformation between the hull and the tank cover 3. By forming the annular upper deck portion 20 also as a flexible structure having no rib member, it can contribute to absorption of relative deformation between the tank cover 3 and the hull.

In this way, the interference forces between the hull and the tank cover 3 generated by the longitudinal bending moment 8, will be absorbed by the side of the hull structure. Thus, the interference forces acting upon joint portions between the tank cover 3 and the upper deck 2, which were the cause of generation of damage in the heretofore known carrying vessels, can be greatly reduced.

In addition, by interposing the short cylindrical member 7 between the hemispherical shell-like member 3 and the upper deck 2, such short cylindrical member can better absorb the above-mentioned interference forces due to sheet bending of the cylindrical sheet forming the short cylindrical member 7.

Figure 7A:
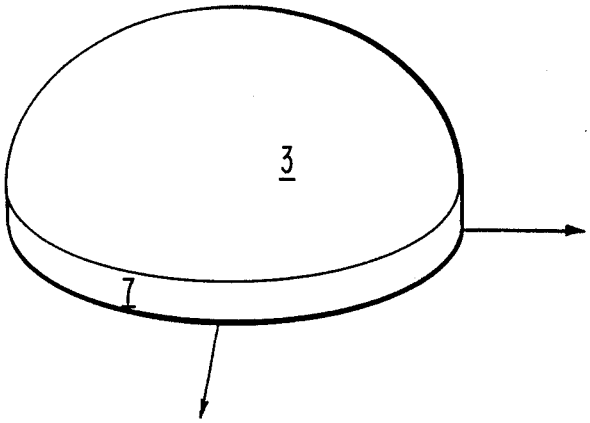
Figure 7B:
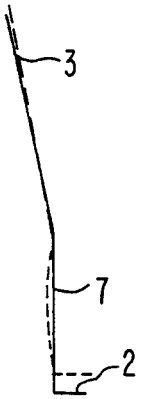
Figure 7C:
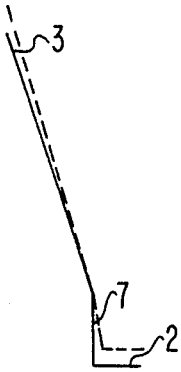
Figure 8:
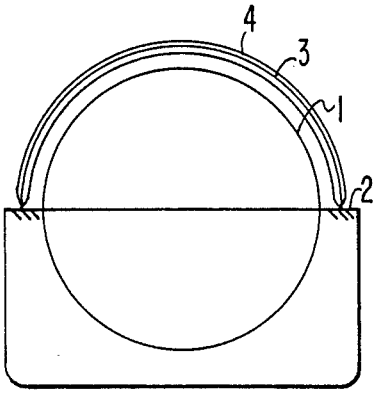
FIG. 8 (PRIOR ART)
FIGS. 8 through 12 show a liquefied gas carrying vessel associated with a tank cover in the prior art, FIG. 8 being a transverse cross-sectional view of a hull in the liquefied gas carrying vessel, FIG. 9 being a longitudinal cross-sectional view of the hull FIG. 10 being a top view of the hull, FIG. 11 being a cross-sectional view of an expansion joint in the tank cover (a cross-sectional view taken along line a—a as viewed in the direction of arrows in FIG. 10), and FIG. 12 being a front view showing a transverse bulkhead of the hull.
Figure 10:
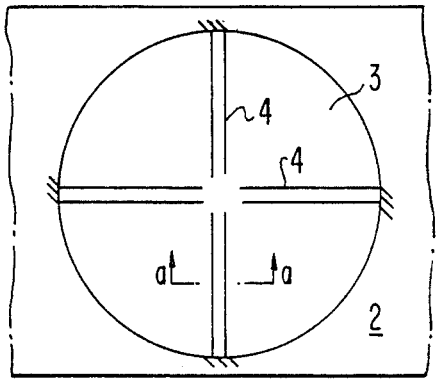
FIG. 10 (PRIOR ART)
Figure 9:
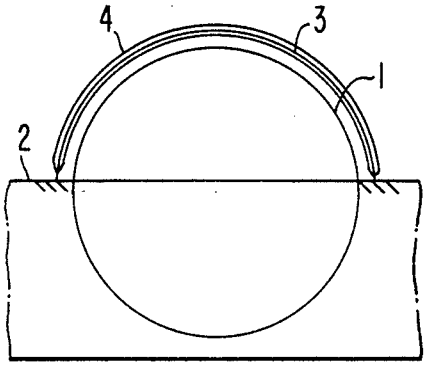
FIG. 9 (PRIOR ART)
Figure 11:
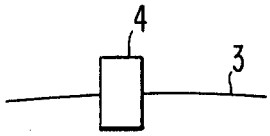
FIG. 11 (PRIOR ART)
Figure 12:
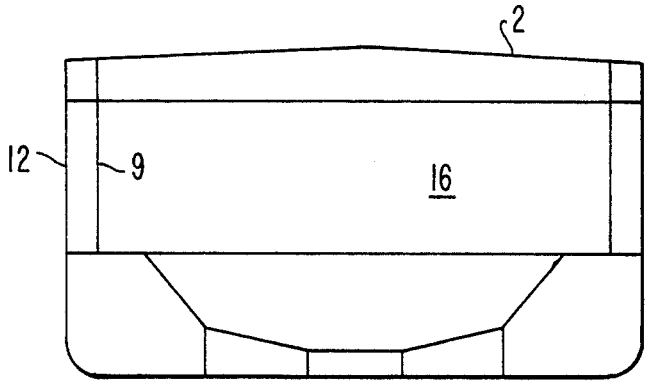
FIG. 12 (PRIOR ART)

Further explanation of the effects of the short cylindrical member 7 will be with reference to FIGS. 7(*a*), 7(*b*) and 7(*c*). In the case where a longitudinal bending moment 8 as shown in FIG. 1 has acted upon the hull, since the tank cover 3 tends to deform into an elliptic shape directed in the back and forth directions, it deforms outwards at the front and rear portions and inwards at the side portions. However, as the short cylindrical member 7 has an extremely low rigidity as compared to the tank cover 3, bending deformation would occur as show by dashed lines in FIGS. 7(*b*) and 7(*c*), and thereby absorption of the relative deformation between the tank cover 3 and the hull can be made more effective.

In this way, in the illustrated liquefied gas carrying vessel associated with a tank cover, the relative interference forces between the hull and the tank cover 3 arising in the event that the hull is deformed by the weight of a load or by waves are mostly absorbed by the flexible hull structure such as the short cylindrical member 7, the annular upper deck portion 20, the hull transverse bulkheads 16 and the like.

It is to be noted that the height of the short cylindrical member 7 is, in the illustrated embodiment, about 1.5 m for a radius of about 20 m of the tank cover 3.

Figure 13:
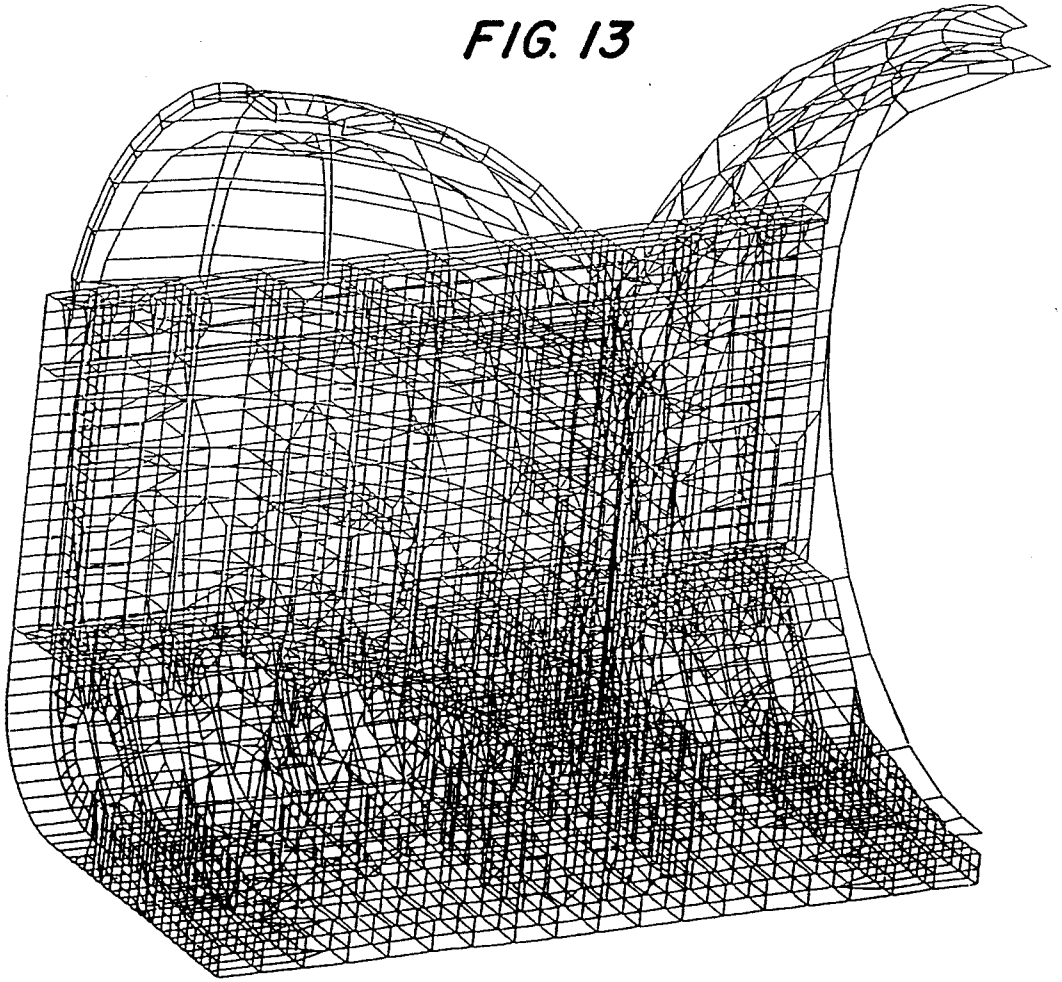
FIGS. 13 through 24 graphically show an FEM model of a liquefied gas carrying vessel associated with a tank cover according to one preferred embodiment of the present invention and that in the prior art as well as results of analyses based on the FEM model, FIG. 13 being a graphical representation of an FEM model of one preferred embodiment of the present invention, FIG. 14 being a graphical representation of vertical displacements of respective portions of a transverse bulkhead of the hull according to the invention, FIG. 15 being a graphical representation of an FEM model of the tank cover of the invention, FIG. 16 being a graphical representation of an FEM model of the tank cover in the prior art, FIG. 17 being a graphical representation of principal stresses generated at the base portion of the prior art expansion joint directed in the left and right directions due to a longitudinal bending moment of the hull, FIG. 18 being a graphical representation of similar principal stresses generated due to an inner pressure of the prior art tank cover, FIG. 19 being a graphical representation of principal stresses generated at the center of the base portion of the prior art tank cover due to a longitudinal bending moment of the hull, FIG. 20 being a graphical representation of principal stresses generated at the same location due to an inner pressure of the prior art tank cover, FIG. 21 being a graphical representation of principal stresses generated at the center of the short cylindrical portion in one preferred embodiment of the present invention due to a longitudinal bending moment of the hull, FIG. 22 being a graphical representation of principal stresses generated at such portion due to an inner pressure of the tank cover, FIG. 23 being a perspective view showing deformations generated at the center of the short cylindrical portion in one preferred embodiment of the present invention due to a longitudinal bending moment of the hull and FIG. 24 being a perspective view showing deformations generated on the center line side of such short cylindrical portion due to a longitudinal bending moment of the hull.

In order to confirm the effect of the present invention in connection with the above-described preferred embodiment of the invention, there was prepared a numerical model for a block on one side of one hold length with a hull transverse bulkhead placed therein as shown in FIG. 13 taken out from a hull, a tank and a tank cover of an LNG carrier provided with a hemispherical shell-like tank cover not having an expansion joint and with hull transverse bulkheads having large openings. Results obtained when FEM (Finite Element Method) analysis was executed while loading a hull longitudinal bending moment of 650,000 ton.m (a designed value for an actual ship) upon the front and rear end surfaces of such model are indicated in the following.

Figure 14:
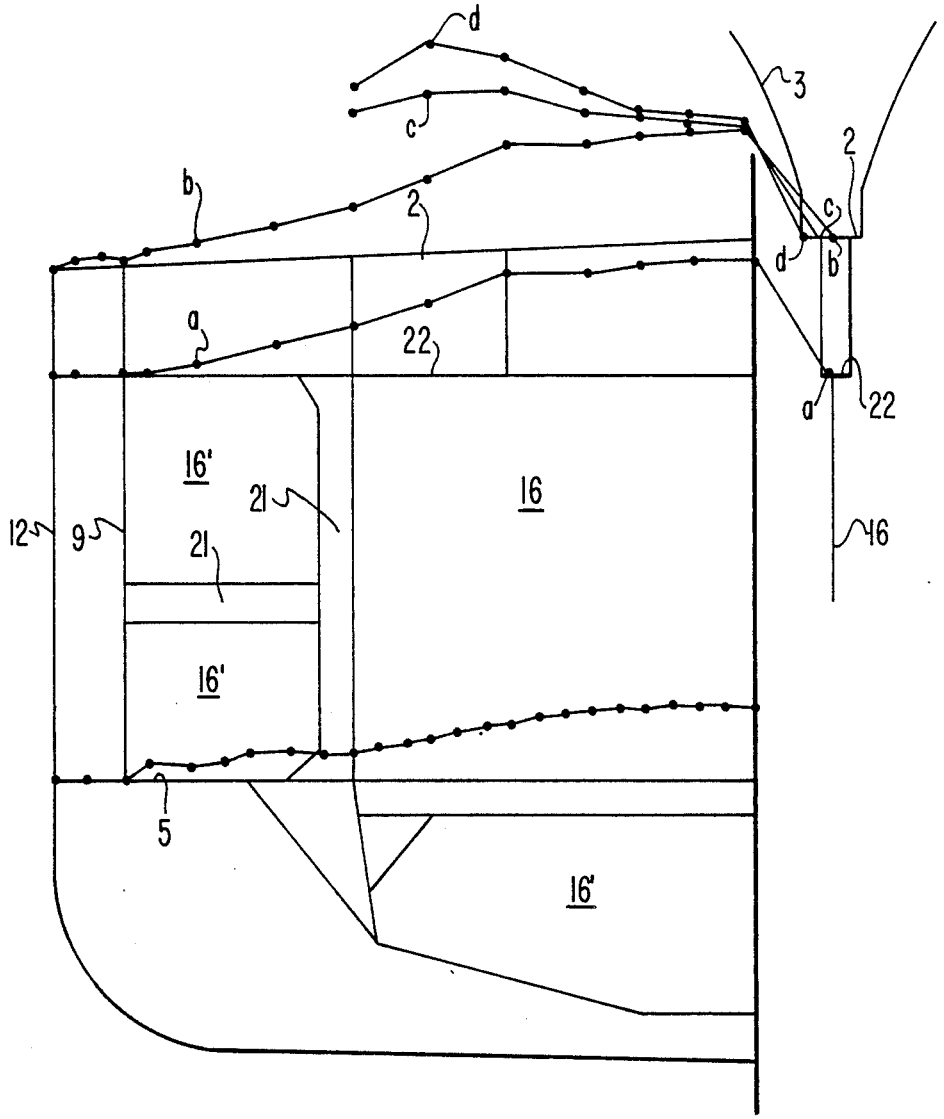

With regard to vertical displacements of respective portions of the transverse bulkhead, the vertical displacements of the upper deck 2, a second deck 22 and the foundation deck 5 as seen in the longitudinal cross-section shown in the right side portion of FIG. 14, would have the values indicated in FIG. 14 taking the respective cross-points of the upper deck 2, the second deck 22 and the foundation deck 5, respectively, with the side plate 12 as reference points. More particularly, in FIG. 14 the plotted points above deck 5 indicate displacement from the horizontal of deck 5. Plotted points a show displacement from the horizontal of second deck 22. Plotted points b show displacement from the horizontal of upper deck 2. Plotted points c and d show displacement of the arcuate portion that is shown as hatched in FIG 1. The plotted points a through d at the right-hand of FIG. 14 indicate the locations of such points in the fore and aft directions. As will be apparent from FIG. 14, due to the provision of the large openings 16′, the hull transverse bulkhead 16 becomes flexible for deformation in its plane, and according to displacement of the tank cover 3, it upheaves at portions on the respective sides of the center line. It is to be noted that with regard to the scope and size of an effective large opening 16′, it is favorable that the openings 16′ are designed as openings extending nearly over the entire region in the widthwise direction of the hull and the size is designed to be about 30% or more of the transverse cross-sectional area of the hull.

Figure 15:
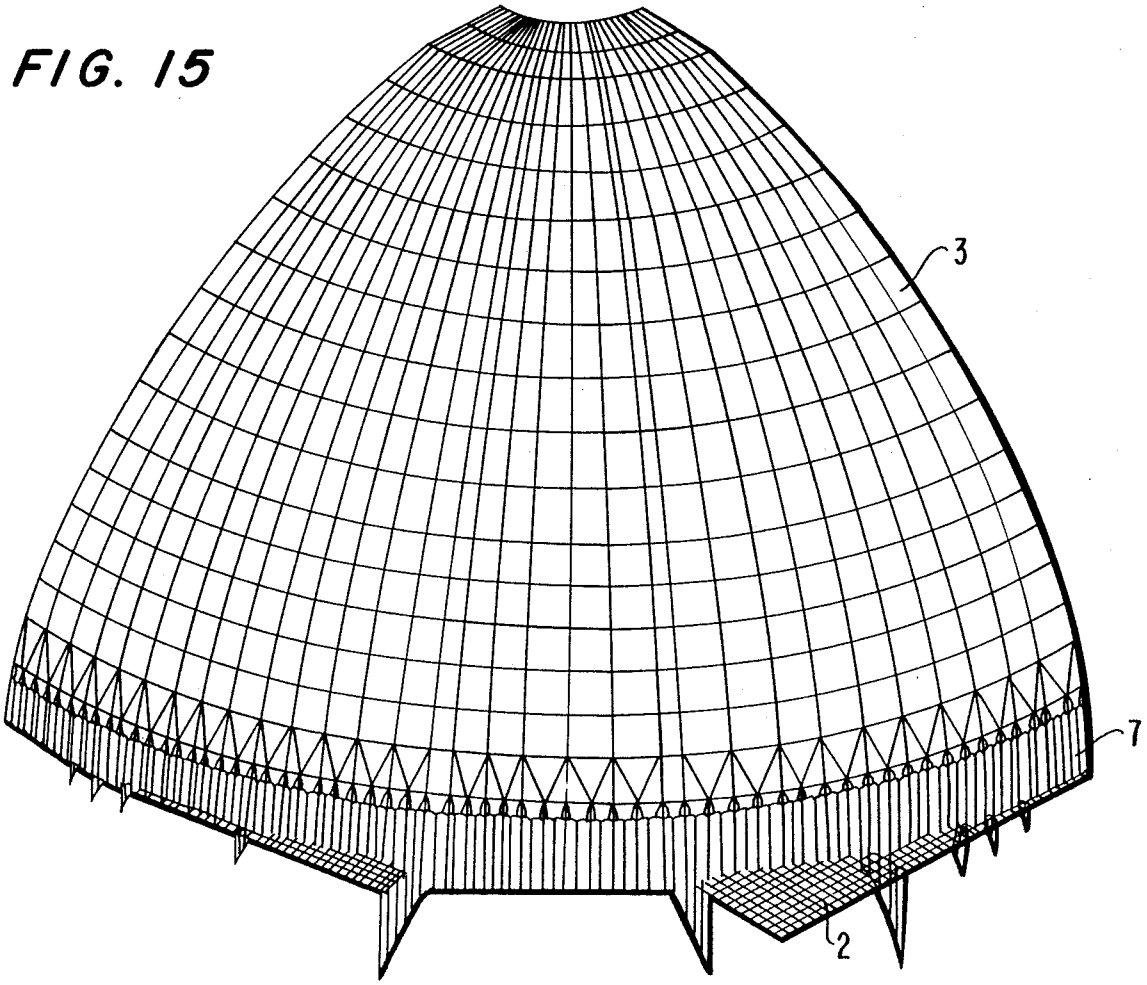

Subsequently, in order to confirm a stress level reduction effect as compared to the heretofore known structure, an FEM model of a tank cover according to one preferred embodiment of the present invention shown in FIG. 15 and an FEM model of the heretofore known tank cover shown in FIG. 16, were prepared and analyzed. The load employed for this FEM analysis was of the following two types (the designed values for the LNG carrier according to one preferred embodiment of the present invention):

(1) hull longitudinal bending moment: 650,000 ton.m (hogging)

(2) tank cover inner pressure: 0.15 kg/cm$^2$ (positive pressure, gauge pressure)

Figure 16:
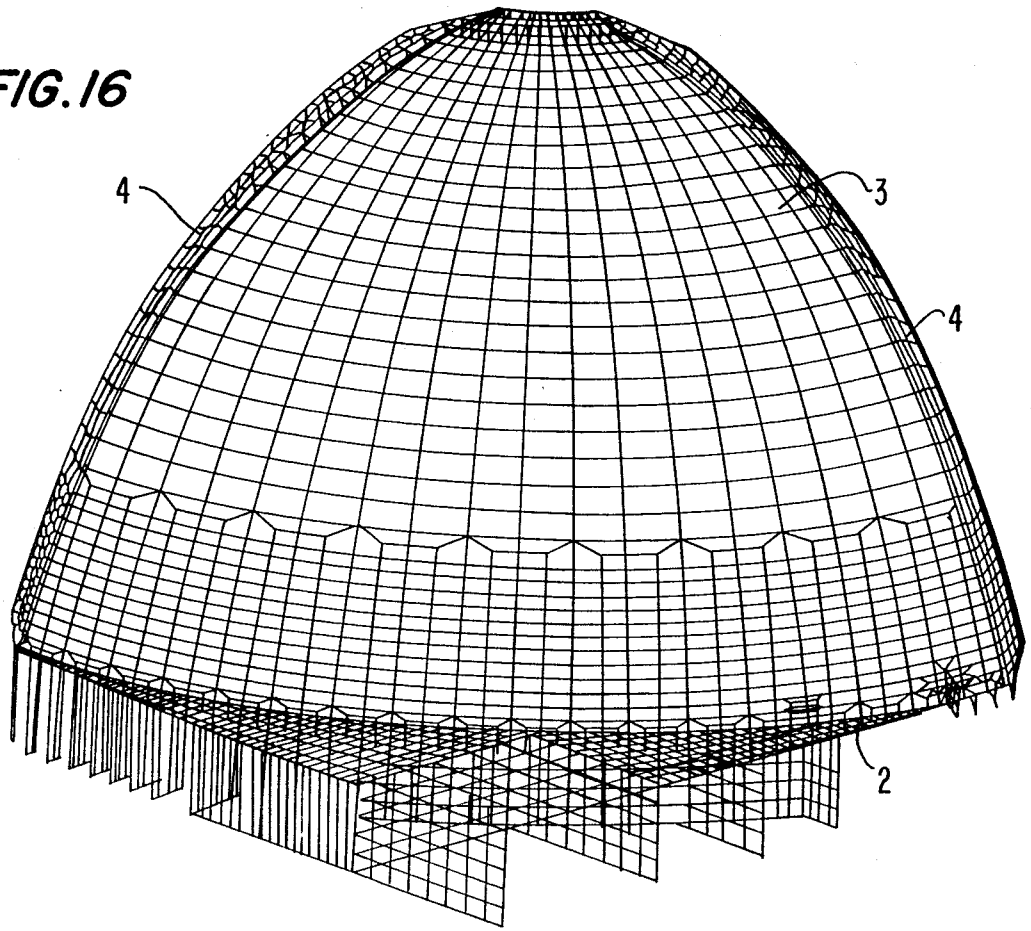
Figure 17:
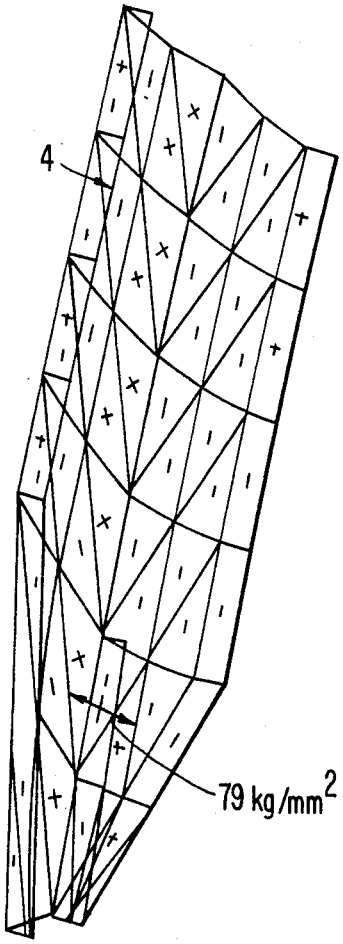
Figure 18:
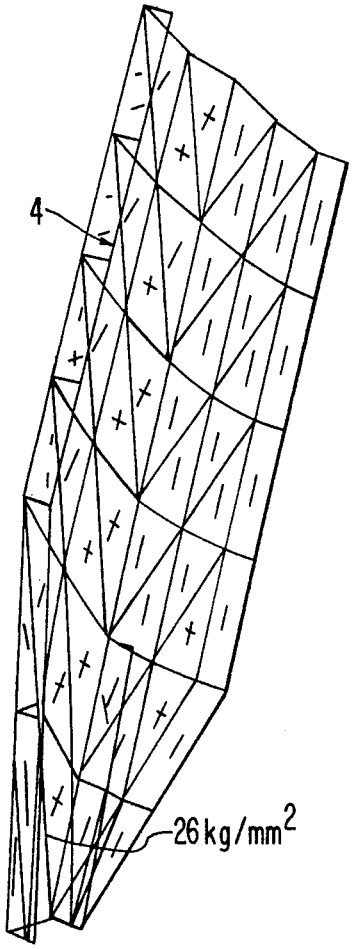
Figure 19:
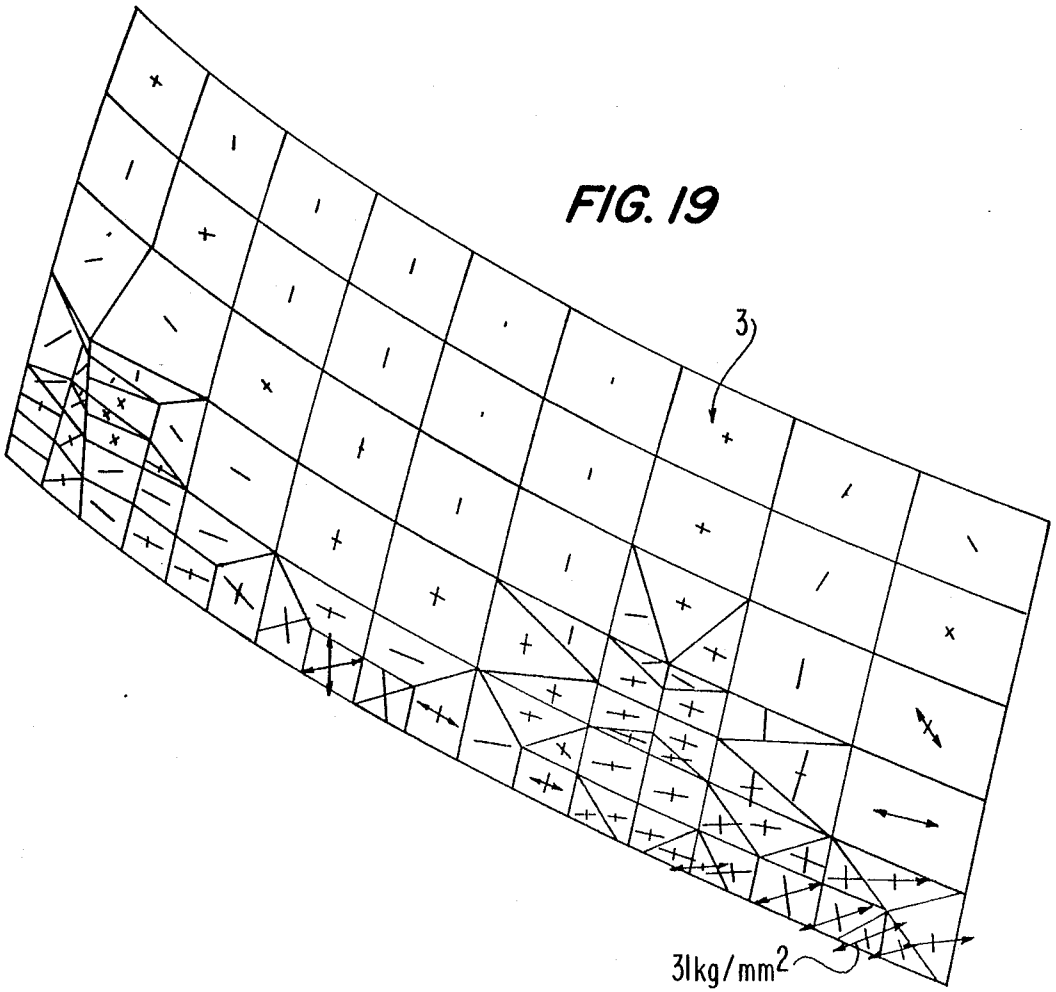
Figure 20:
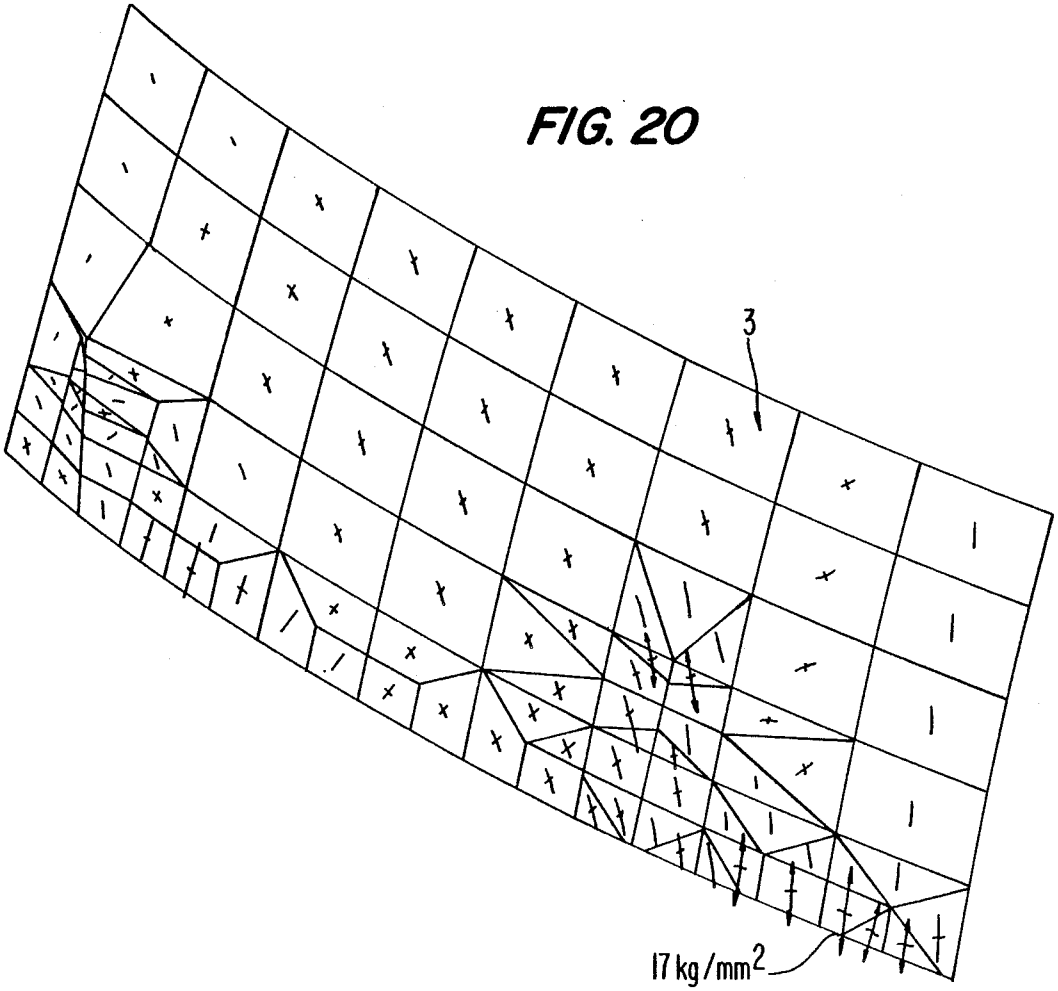
Figure 21:
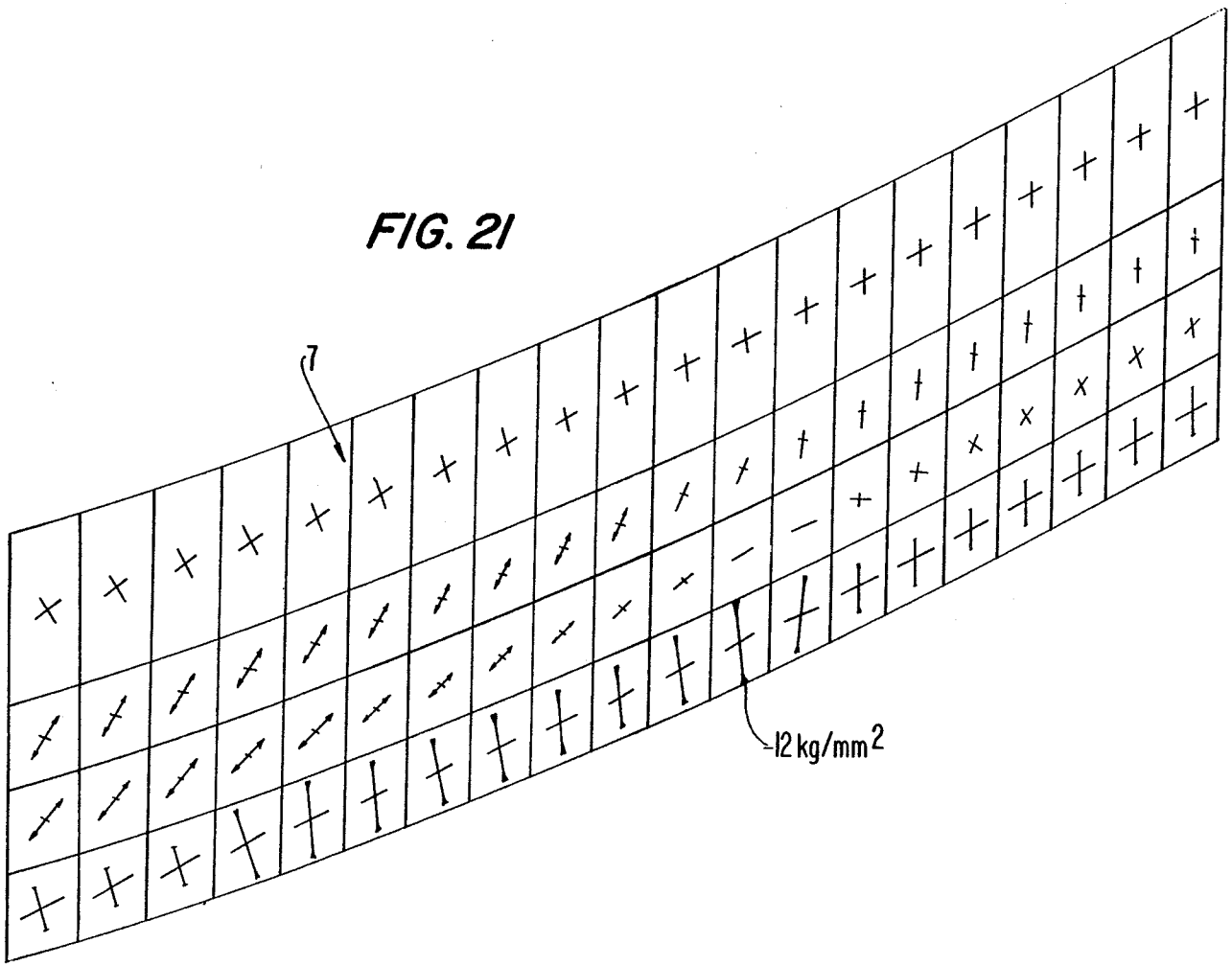
Figure 22:
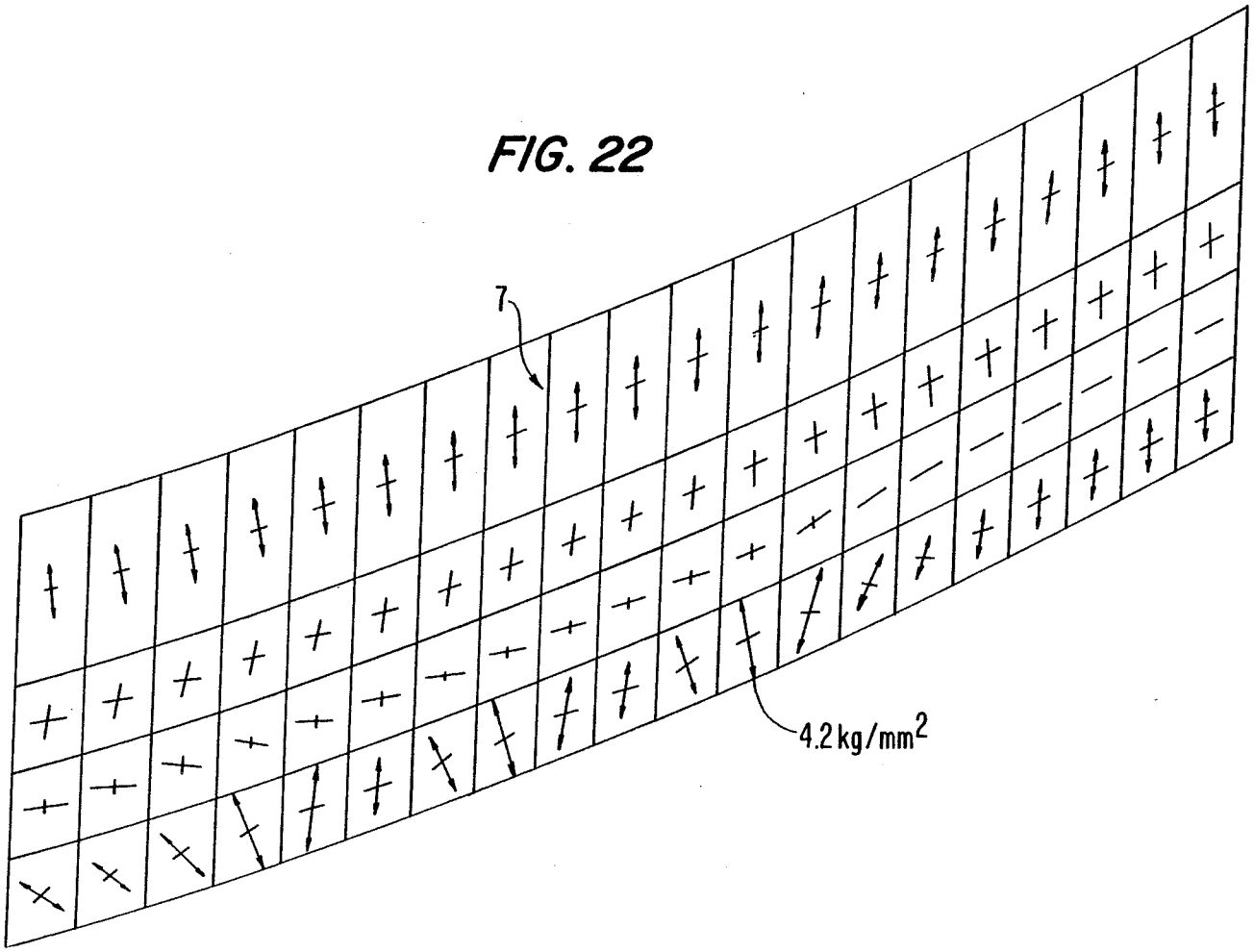

FIGS. 17 and 18 indicate the lower part of the expansion joint 4 shown in the lower right-hand portion of FIG. 16. FIGS. 19 and 20 indicate the lower part of the cover 3 shown in the lower right-hand portion of FIG. 16. FIGS. 21 and 22 indicate the portion of the short cylindrical member 7 in the vicinity of the center of the hold shown in the lower right-hand portion of FIG. 15. In FIGS. 17–22, major principle stresses and minor principle stresses are shown by vectors, with tension being indicated by outwardly directed arrows and compression being indicated by inwardly directed arrows.

In the heretofore known structure, the value of the stress generated at the base portion of the expansion joint 4 in which cracking damage occurred was proved, as a result of the FEM analysis, to be 79 kg/mm$^2$ as shown in FIG. 17 for the hull longitudinal bending moment of 650,000 ton.m, and to be 26 kg/mm$^2$ as shown in FIG. 18 for the inner pressure of 0.15 kg/cm$^2$. Furthermore, the stress value at the joint portion between the base portion of the tank cover 3 and the upper deck 2 where cracks were generated in the prior art, was proved to be 31 kg/mm$^2$ (FIG. 19) for the hull longitudinal bending moment of 650,000 ton.m, and to be 17 kg/mm$^2$ (FIG. 20) for the inner pressure.

Whereas, in the preferred embodiment of the present invention, at the joint portion between the short cylindrical member 7 and the upper deck 2, the stress value was proved to be 12 kg/mm$^2$ (FIG. 21) for the hull longitudinal bending moment of 650,000 ton.m and to be 4.2 kg/mm$^2$ (FIG. 22) for the inner pressure. Thus, the stress values are greatly reduced as compared to those in the heretofore known structure.

Figure 23:
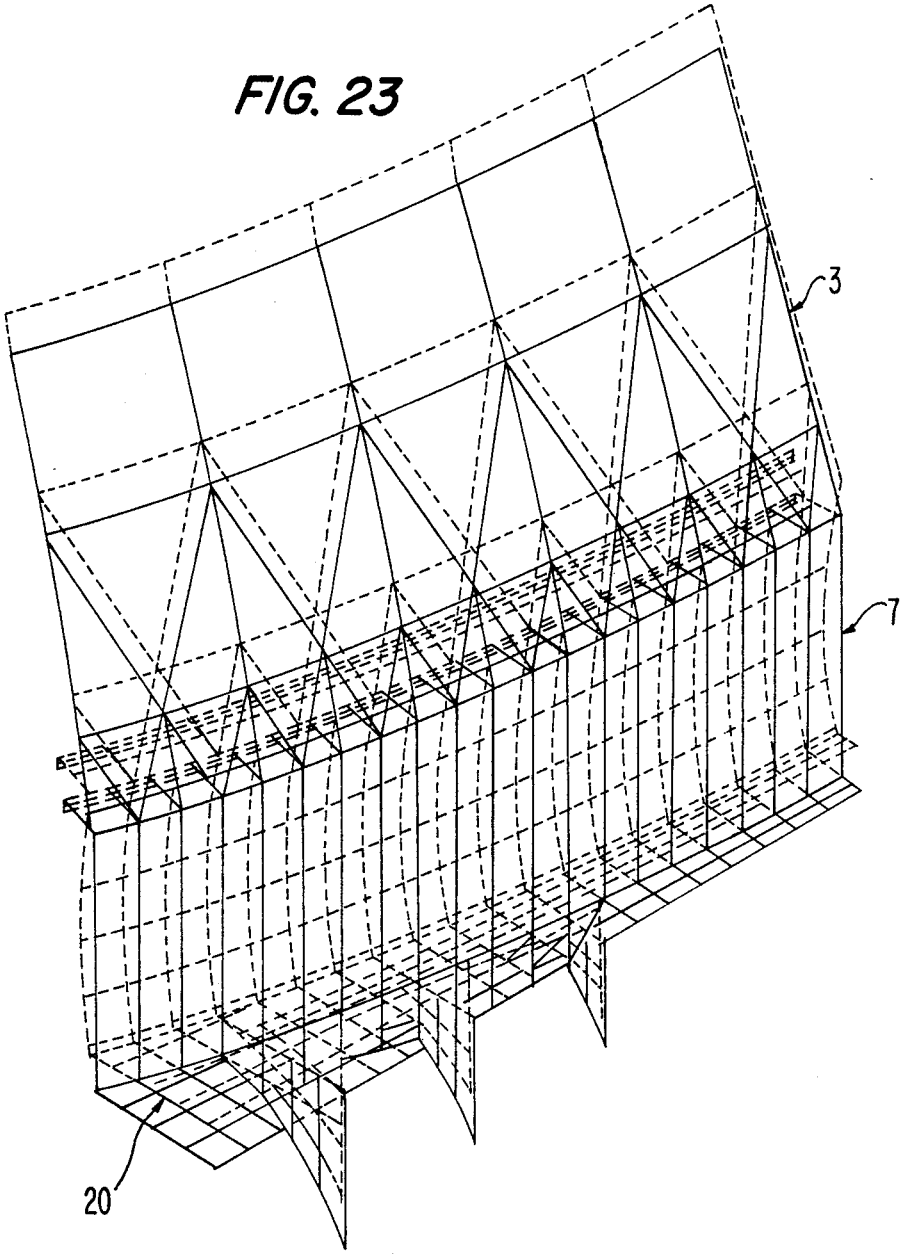
Figure 24:
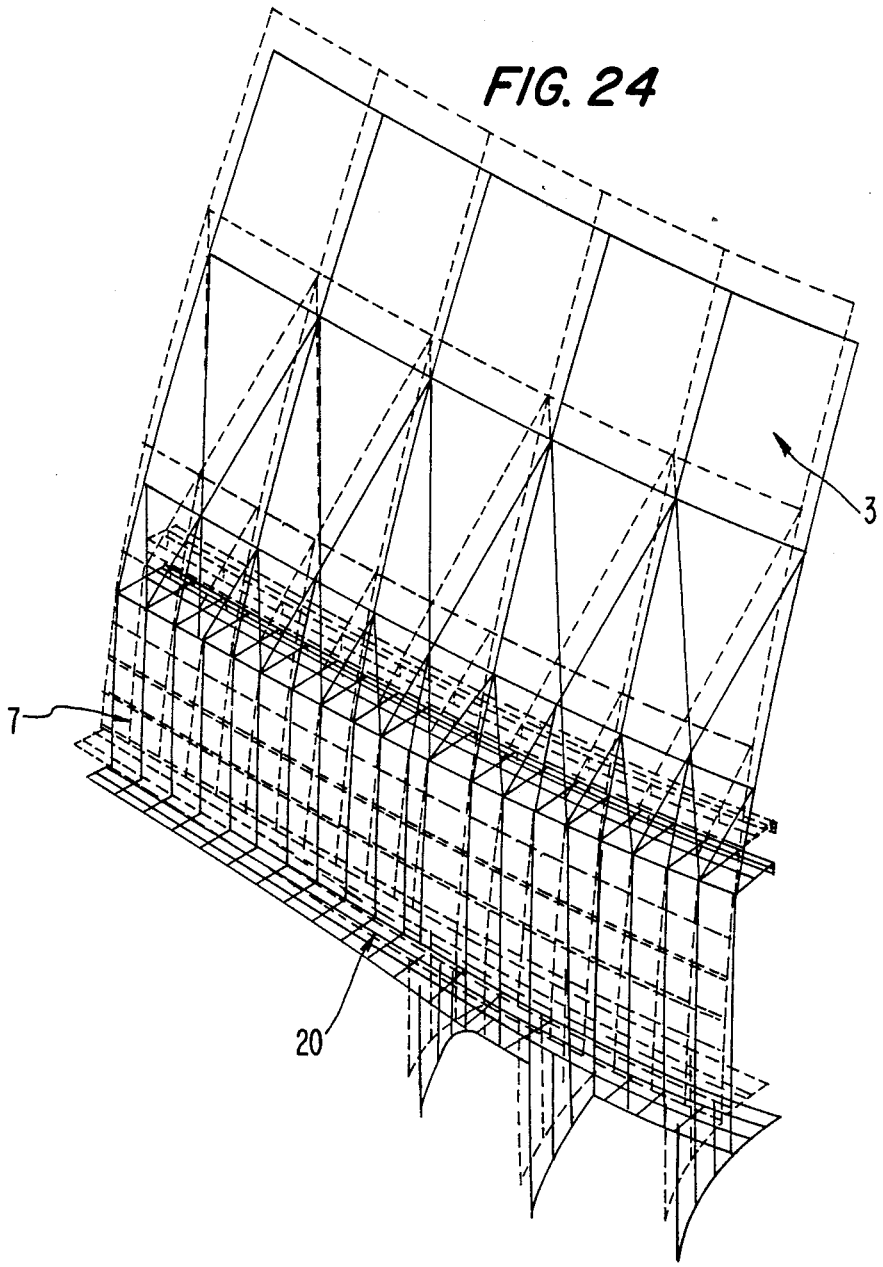

The above-described stress reduction effects of the present invention result from, besides the effect of the large openings 16' in the hull transverse bulkheads 16, the effect that the short cylindrical member 7 deforms flexibly and absorbs the relative displacement between the tank cover 3 and the hull, and this is confirmed as a result of the above-described FEM analysis In other words, in FIGS. 23 and 24, the short cylindrical member 7 intervening between the tank cover 3 and the upper deck 2, or upper deck portion 20, can absorb relative displacement therebetween without generating a high stress, as a result of deformation in a direction outwardly of its surface. In FIGS. 23 and 24 the configuration of the FEM model before deformation is indicated by solid lines and after deformation is indicated by dashed lines.

While a liquefied gas carrying vessel associated with a tank cover according to one preferred embodiment of the present invention has been described above, the present invention should not be limited to only the above-described embodiment. Rather, the invention can be practiced generally in any ship having a dome on its upper deck and, for instance, it can be embodied in a leisure barge having a hemispherical roof. In addition, especially with regard to the configuration of the hemispherical shell-like member of the dome or the short cylindrical member, such terms are not limited to be strictly spherical or cylindrical. Rather, the dome could be a polygonal pyramid approximated to a hemisphere (poor in mechanical strength because knuckle lines are produced), and the short cylindrical member could be a circular conical shape.

As described in detail above, a ship having a dome on its upper deck according to the present invention provides the advantages that, as an expansion joint need not be provided in the dome, it becomes possible to eliminate damage at the joint portion between the dome and the hull which was generated in the prior art as a side effect of the expansion joint, and also the labor and expense necessitated for manufacture and mounting of the expansion joint can be greatly reduced.

Since many changes and modifications can be made to the above-described construction without departing from the spirit of the present invention, it is intended that all matter contained in the above description and illustrated in the accompanying drawings shall be interpreted to be illustrative and not limiting.

What is claimed is:

1. In a ship including a hull having therein a plurality of transverse bulkheads spaced from each other in the bow-stern direction of said hull, ballast tanks in opposite sides of said hull, an upper deck having therein at least one opening between two adjacent said transverse bulkheads, and a dome covering said opening, the improvement comprising:

said dome being a hemispherical shell-like member having a rigid structure free of expansion joints;

a cylindrical member of relatively short axial length connecting the circumferential edge of said hemispherical shell-like member with the circumferential edge of said upper deck defining said opening therein;

each said transverse bulkhead being formed as a flexible structure having therethrough relatively large openings; and said ballast tanks and said transverse bulkheads being jointly constructed to provide water-tight structures.

2. The improvement claimed in claim 1, further comprising a spherical tank positioned between said two adjacent transverse bulkheads and projecting upwardly through said opening in said upper deck, said dome covering the upper portion of said spherical tank.

* * * * *